US009125483B1

(12) United States Patent
Diaz

(10) Patent No.: US 9,125,483 B1
(45) Date of Patent: Sep. 8, 2015

(54) BRUSH HAVING REMOVABLE BRISTLES

(71) Applicant: Christopher Diaz, Hempstead, NY (US)

(72) Inventor: Christopher Diaz, Hempstead, NY (US)

( * ) Notice: Subject to any disclaimer, the term of this patent is extended or adjusted under 35 U.S.C. 154(b) by 0 days.

(21) Appl. No.: 14/313,393

(22) Filed: Jun. 24, 2014

(51) Int. Cl.
*A46B 7/04* (2006.01)
*A46B 5/00* (2006.01)

(52) U.S. Cl.
CPC . *A46B 7/042* (2013.01); *A46B 7/04* (2013.01); *A46B 5/0095* (2013.01); *A46B 2200/01* (2013.01); *A46B 2200/1033* (2013.01)

(58) Field of Classification Search
CPC ..... A46B 5/0095; A46B 7/04; A46B 7/042; A46B 7/044; A46B 2200/01; A46B 2200/1033
USPC ..... 15/145, 176.1, 176.4–176.6, 194, 202
See application file for complete search history.

(56) References Cited

U.S. PATENT DOCUMENTS 890,348 A * 6/1908 Felix ..... 15/194
950,377 A * 2/1910 Downey ..... 15/194
1,475,673 A * 11/1923 Albright, Jr. ..... 15/194
1,493,848 A * 5/1924 Ebert ..... 15/176.6
1,729,909 A * 10/1929 Simmons ..... 15/248.1
1,879,552 A * 9/1932 Silva et al. ..... 15/194
1,879,553 A * 9/1932 Silva et al. ..... 15/176.1
1,910,132 A * 5/1933 Silva et al. ..... 15/194
1,959,274 A * 5/1934 Mar ..... 15/194
2010/0095973 A1* 4/2010 Shrier et al. ..... 132/200

FOREIGN PATENT DOCUMENTS

FR 585387 * 2/1925

* cited by examiner

*Primary Examiner* — Mark Spisich
(74) *Attorney, Agent, or Firm* — Gulf Coast Intellectual Property Group

(57) ABSTRACT

A brush operable to remove hair clippings from the face and neck of a user wherein the brush includes a releasably secured bristle portion so as to facilitate a one-time use thereof so as to comply with health regulations. The brush includes a handle portion that is substantially hollow having a first end and a second end. A bristle portion is provided that includes an annular base having a shank extending outward therefrom opposite the bristles. Disposed within the handle is a connection assembly that facilitates the releasable securing of the bristle portion to the handle.

6 Claims, 2 Drawing Sheets

BRUSH HAVING REMOVABLE BRISTLES

FIELD OF THE INVENTION

The present invention relates generally to salon accessories, more specifically but not by way of limitation, a dusting brush that is operable to clean hair from a client's neck and face area wherein the brush includes a brush element having a plurality of bristles that is releasably secured to a handle.

BACKGROUND

Barbers and hairdressers utilize many implements during the execution of their jobs. From scissor to various brushes and combs, chemicals and numerous other tools are used during the cutting and styling of a client's hair. Sterilization and cleanliness are not only important for the client and the barber, most states provide strict regulation about cleaning and use of various implements in order to prevent the spread of bacteria, lice and other illnesses.

During the process of cutting hair, the hair remnants typically fall on the client's neck and shoulder area. It is standard for clients to have a salon cape draped around their shoulder so as to prevent the hair from coming in contact with the clients clothes. While most of the hair falls onto the floor or the salon cape, inevitably some of the hair clings to the neck, ears and face of the client receiving a haircut. Hairdressers and barbers will use small towels and other similar devices to attempt to remove the hair clippings but these do not work as well as a brush. One problem with conventional brushes is that they are not allowed for repetitive use by most state health boards. The use of a brush on more than one client is a violation of health regulations in most states.

Accordingly, there is a need for a brush that is effective at removing hair from the neck and face area of a person who has received a haircut wherein the brush includes a brush element having a plurality of bristles that is releasably secured to the handle so as to facilitate the removal of the brush element and the replacement with a new unused brush element.

SUMMARY OF THE INVENTION

It is an object of the present invention to provide a brush that is operable to remove hair clippings from the neck and face area of a person wherein the brush has a removable bristle element.

Another object of the present invention is to provide a brush operable to remove hair clippings from the neck area of a user wherein the removable bristle element includes a base and a plurality of bristles extending therefrom.

A further object of the present invention is to provide a brush configured for use to remove hair clippings from a person's neck area wherein the removable bristle element further includes a shaft extending from a base.

Still another object of the present invention is to provide a brush operable to remove hair clippings from the neck area of a person that includes a handle that is configured to releasably secure to the brush element.

An additional object of the present invention is to provide a brush configured to remove hair clippings from the neck area of a user that includes a handle wherein the handle is substantially hollow having an interior volume of suitable size to accommodate the necessary components to facilitate the releasably securing of the brush element thereto.

Yet a further object of the present invention is to provide a brush operable to remove hair clippings from a neck area of a person having a removable brush element wherein the handle further includes a push button operable to facilitate the release of the brush element from the handle.

Still another object of the present invention is to provide a brush operable to remove hair clippings from neck area of a person wherein the removable brush element further includes a sanitary enclosure for storage prior to use thereof.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
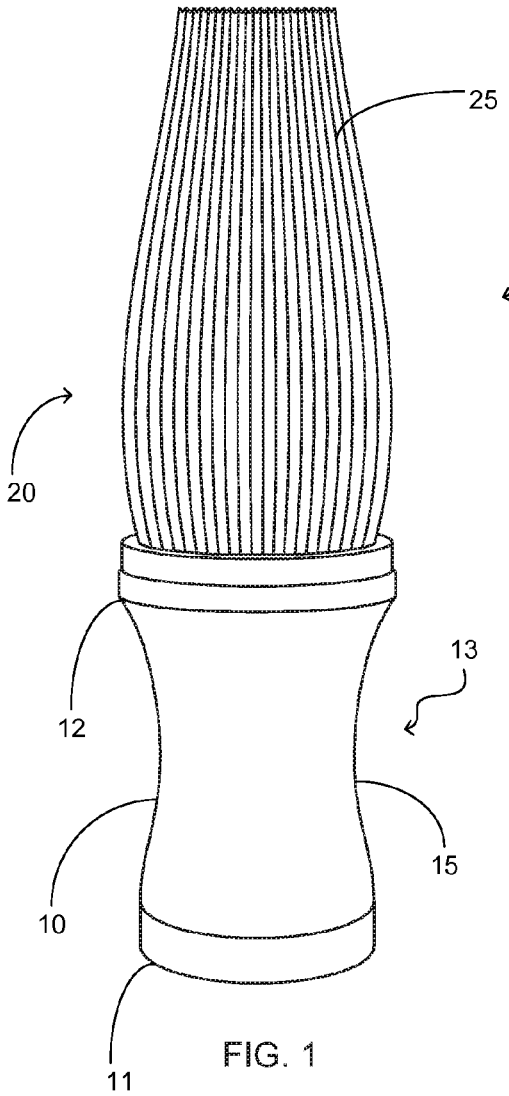
FIG. 1 is a perspective view of the present invention.

Referring now to the drawings submitted herewith, wherein various elements depicted therein are not necessarily drawn to scale and wherein through the views and figures like elements are referenced with identical reference numerals, there is illustrated an hair brush 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1 herein, the hairbrush 100 further includes a handle 10 manufactured from a suitable durable material such as but not limited to plastic. The handle 10 includes first end 11 and second end 12. The handle 10 is modified cylindrical in shape wherein the mid-portion 13 of the handle 10 has a diameter that is less than that of the diameter of the first end 11 and second end 12. The outer wall 15 of the handle 10 tapers inward towards the mid-portion 13 from both the first end 11 and the second end 12. The tapered-cylindrical shape of the handle 10 promotes an ergonomic grip for the user of the hair brush 100 when utilizing the hair brush to remove hair clipping from the neck and face area of a person who has received a hair cut. The handle 10 is substantially hollow so as to accommodate the components further discussed herein. While a particular shape for the handle 10 has been disclosed herein, it is contemplated within the scope of the present invention that the handle 10 could be formed in numerous different shapes.

Figure 2:
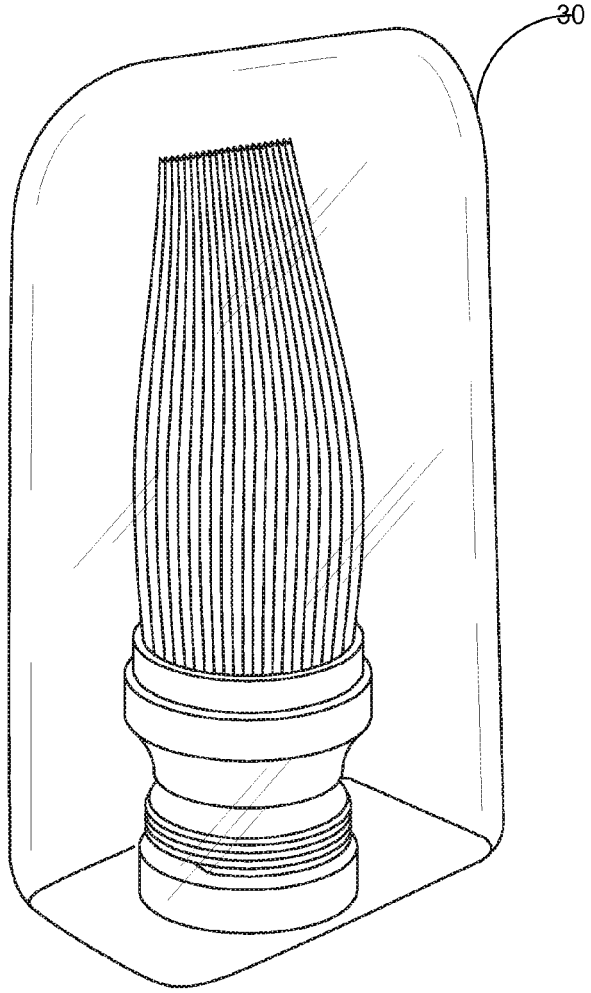
FIG. 2 is a perspective view of the brush element of the present invention disposed in its sanitary enclosure.
Figure 3:
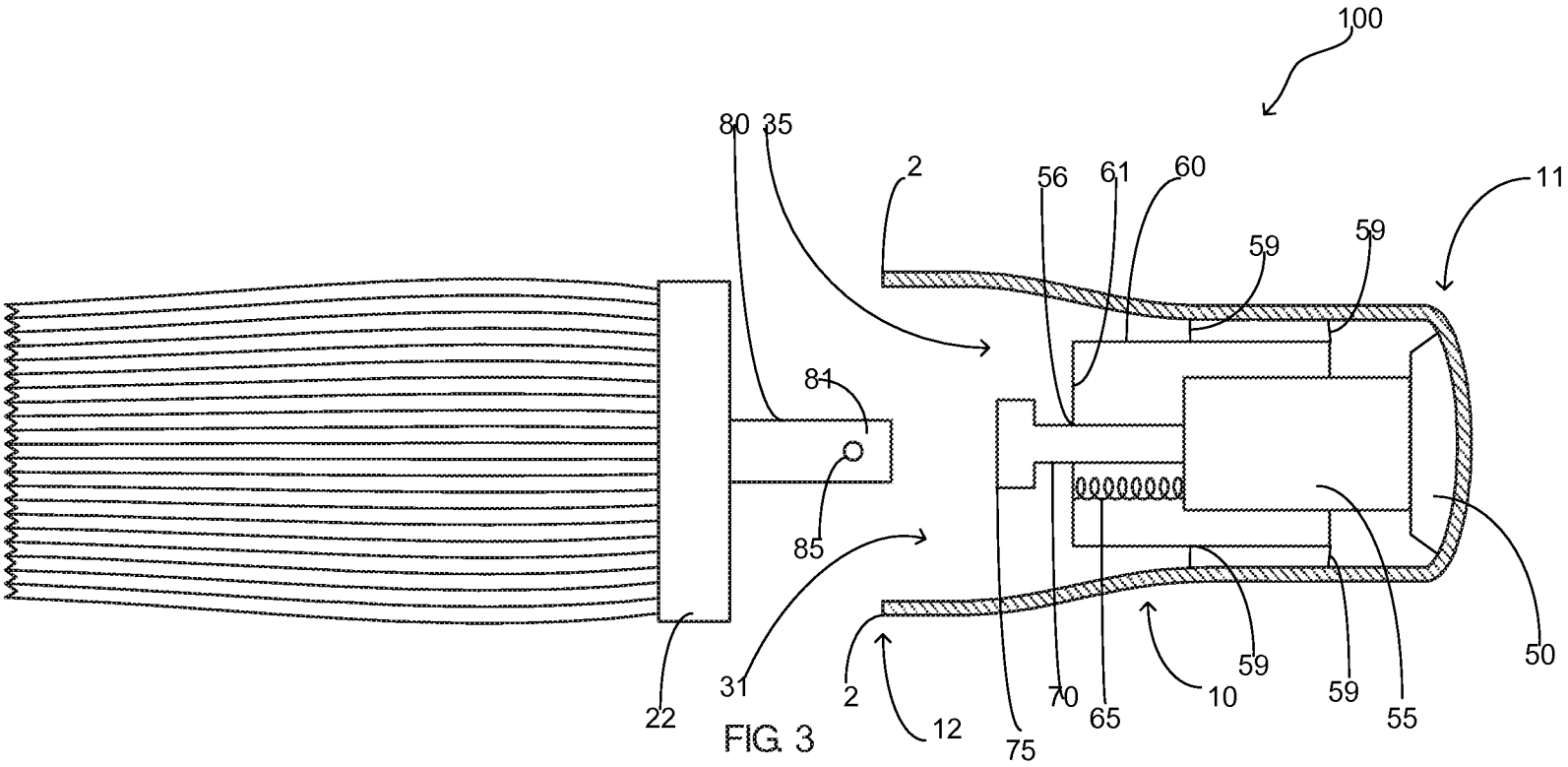
FIG. 3 is a cross-sectional view of an embodiment of the present invention.

Releasably secured to the handle 10 is the bristle portion 20. The bristle portion 20 is releasably secured to the handle 10 proximate second end 12. The bristle portion 20 includes a base 22 that is annular in shape and is sized so as to mateably connect with the second end 12 as shown in FIG. 3 herein. The bristle portion 20 includes a plurality of bristles 25 extending outward from the base 22. The bristles 25 are manufactured from a suitable durable material such as but not limited to nylon. Shown in particular in FIG. 2 herein is the storage receptacle 30 for the bristle portion 20. The storage receptacle 30 is a sealed bag manufactured of a suitable durable material such as but not limited to plastic. The storage receptacle 30 functions to hygienically store the bristle portion 20 until ready for use by a user. Those skilled in the art will recognize that the storage receptacle could be manufactured utilizing numerous different types of materials in order to achieve the functionality as described herein.

Referring in particular to FIG. 3 herein, a cross-sectional view of the hairbrush 100 is illustrated therein. The handle 10 includes bristle securing components 35 disposed within the interior volume 31 of the handle 10. A button 50 is moveably secured to the first end 11 of the handle 10. The button 50 includes plunger body 55 that is movably secured to plunger mount 60. The plunger mount 60 is substantially hollow so as to allow the plunger body 55 to move therethrough in an upwards-downwards movement. The plunger mount 60 is secured within he interior volume 31 of the handle 10 utilizing supports 59. The plunger body 55 is biased by spring 65. The spring 65 is mounted to the bottom 61 of the plunger mount 60 and functions to bias the plunger body 55 in an upwards position. Secured to the plunger body 55 is shaft 70. Shaft 70 extends outward from plunger mount 60 through opening 56. A receptacle 75 is secured to shaft 70. The receptacle 75 is configured to releasably receive shank 80. Proximate end 81 of shank 80 is locking knob 85. The locking knob 85 engages with the interior of the receptacle 75 so as to provide increased connection strength between the receptacle 75 and shank 80.

Referring to figures herein, a description of the operation of the hairbrush 100 is as follows. In use, a user will remove the bristle portion 20 from the storage receptacle 30. As the user depresses the button 50, the plunger body 55 moves downward compressing spring 65. As this movement occurs, the shaft 70 and receptacle 75 extend outward from the handle 10 partially beyond the second end 12. The user will then place end 81 of shank 80 into receptacle 75 wherein the locking knob 85 provides a secure connection thereto. The user will then release the button 50 allowing the spring 65 to extend moving the plunger body 55 towards the first end 11. As the movement is completed the base 22 will be disposed within the wall 2 of the second end 12. This position substantially inhibits any movement of the base 22 from lateral forces applied during the use of the hairbrush 100.

While a particular embodiment of the hair brush 100 has been disclosed herein having components 35 operable to releasably secure the bristle portion 20 to the handle 10, it is further contemplated within the scope of the present invention that numerous types of mechanical fasteners could be used in place of and/or in conjunction with the components 35 illustrated and discussed herein to facilitate the releasable securing of the bristle portion 20 to the handle 10.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A brush operable to remove hair clippings from a person comprising:

a handle, said handle having a first end and a second end, said handle being modified cylindrical in shape, said handle having a interior volume that is substantially hollow, said handle further including a button proximate said first end;

a bristle portion, said bristle portion further including a base, said base being annular in shape, said bristle portion including a plurality of bristles, said plurality of bristles extending outward from said base;

a plunger body, said plunger body being operably coupled to said button;

a plunger mount, said plunger mount being configured to receive said plunger body, said plunger mount further having a spring mounted thereto, said spring operable to bias said plunger body;

a shaft, said shaft being secured to said plunger body, said shaft extending outward through said plunger mount, said shaft having a first end and a second end, wherein said shaft further includes a receptacle, said receptacle integrally formed with said shaft opposite said plunger body;

said base of said bristle portion further includes a shank, said shank being perpendicular to said base, said shank having a first end and a second end, said second end of said shank configured to mateably connect with said receptacle; and wherein said bristle portion is releasably secured to said handle so as to facilitate a one-time use only of the bristle portion.

2. The brush as recited in claim 1, wherein said shank further includes a locking knob, said locking knob proximate said second end of said shank.

3. A brush configured to remove hair clippings from the face and neck area of a person comprising:

a handle, said handle being modified cylindrical in shape, said handle having an interior volume being substantially hollow, said handle having a first end and a second end, said handle further including a button movably secured thereto proximate said first end;

a bristle portion, said bristle portion configured to be releasably secured to said handle, said bristle portion further including a base, said base being annular in shape, said base having a plurality of bristles extending outward therefrom;

a connection assembly, said connection assembly being disposed within said interior volume, said connection assembly operable to facilitate the releasable securing of the bristle portion to said handle, wherein the connection assembly further includes a plunger body, said plunger body being operably coupled to said button;

a plunger mount, said plunger mount being configured to receive said plunger body, said plunger mount further having a spring mounted thereto, said spring operable to bias said plunger body;

a shaft, said shaft being secured to said plunger body, said shaft extending outward through said plunger mount, said shaft having a first end and a second end, wherein said shaft further includes a receptacle, said receptacle integrally formed with said shaft opposite said plunger body; and wherein said base of said bristle portion further includes a shank, said shank being perpendicular to said base, said shank having a first end and a second end, said second end of said shank configured to mateably connect with said receptacle.

4. The brush as recited in claim 3, and further including support members, said support members operable to secure said plunger mount within the interior volume of said handle.

5. A cleaning brush operable to remove hair clippings from the face and neck area of a person wherein the cleaning brush is configured to have a bristle portion that is releasably secured so as to facilitate a one time use thereof comprising:

a handle, said handle being modified cylindrical in shape, said handle having an interior volume being substantially hollow, said handle having a first end and a second end, said handle further including a button movably secured thereto proximate said first end;

a bristle portion, said bristle portion configured to be releasably secured to said handle, said bristle portion further including a base, said base being annular in shape, said base having a plurality of bristles extending outward therefrom;

a connection assembly, said connection assembly being disposed within said interior volume, said connection assembly operable to facilitate the releasable securing of the bristle portion to said handle, said connection assembly further including a plunger body, said plunger body being operably secured to said button, said connection assembly further including a plunger mount, said plunger mount being hollow, said plunger body being movable within said plunger mount;

a spring, said spring having a first end and a second end, said spring operably coupling said plunger body and said plunger mount, said spring operable to bias said plunger body in a first position;

a shaft, said shaft being secured to said plunger body, said shaft extending outward through said plunger mount, said shaft having a first end and a second end, wherein said shaft further includes a receptacle, said receptacle integrally formed with said shaft opposite said plunger body;

support members, said support members operable to secure said plunger mount within the interior volume of said handle; and wherein said base of said bristle portion further includes a shank, said shank being perpendicular to said base, said shank having a first end and a second end, said second end of said shank configured to mateably connect with said receptacle.

6. The cleaning brush as recited in claim 5, wherein said shank further includes a locking knob, said locking knob proximate said second end of said shank.

* * * * *